US007321350B2

(12) United States Patent
Lee et al.

(10) Patent No.: US 7,321,350 B2
(45) Date of Patent: Jan. 22, 2008

(54) IMAGE DISPLAY

(75) Inventors: Jae-Sung Lee, Seoul (KR); Choon-Yul Oh, Gunpo (KR); Do-Hyung Ryu, Busan (KR); Jin-Hyun Choi, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 14 days.

(21) Appl. No.: 10/774,535

(22) Filed: Feb. 10, 2004

(65) Prior Publication Data

US 2004/0160168 A1 Aug. 19, 2004

(30) Foreign Application Priority Data

Feb. 10, 2003 (KR) ..... 10-2003-0008218

(51) Int. Cl.
*G09G 3/36* (2006.01)

(52) U.S. Cl. ..... 345/89; 345/82; 345/690; 315/169.3; 315/167; 315/291

(58) Field of Classification Search .. 315/169.1–169.4, 315/160, 167, 291; 313/498–505; 345/76–107, 345/204, 690
See application file for complete search history.

(56) References Cited

U.S. PATENT DOCUMENTS 5,451,978 A * 9/1995 Harju ..... 345/78
5,760,757 A * 6/1998 Tanaka et al. ..... 345/93
5,889,503 A * 3/1999 Kikuchi et al. ..... 345/98
5,910,792 A * 6/1999 Hansen et al. ..... 345/74.1
5,952,789 A * 9/1999 Stewart et al. ..... 315/169.4
6,072,517 A * 6/2000 Fork et al. ..... 347/237
6,121,950 A * 9/2000 Zavracky et al. ..... 345/101
6,388,649 B1 * 5/2002 Tanaka et al. ..... 345/89
6,909,242 B2 * 6/2005 Kimura ..... 315/169.3
6,961,041 B2 * 11/2005 Ilda et al. ..... 345/90
7,064,733 B2 * 6/2006 Cok et al. ..... 345/76
2002/0163490 A1 * 11/2002 Nose ..... 345/89
2002/0196220 A1 * 12/2002 Sato et al. ..... 345/87
2003/0016195 A1 * 1/2003 Sagano et al. ..... 345/75.2
2003/0020677 A1 * 1/2003 Nakano ..... 345/87
2003/0048246 A1 * 3/2003 Ham ..... 345/87

(Continued)

FOREIGN PATENT DOCUMENTS

JP 05-207402 8/1993

(Continued)

*Primary Examiner*—Haissa Philogene
*Assistant Examiner*—Tung X Le
(74) *Attorney, Agent, or Firm*—H.C. Park & Associates, PLC

(57) ABSTRACT

An image display having a display panel including pixels in a matrix pattern, anodes formed corresponding to the pixels, a cathode in common with the anodes, EL elements provided between the anode and the cathode and including a light emitting layer, and TFTs for controlling the current supply to the EL elements. The display also has a scan driver for selecting pixel lines on the display panel, a data driver for applying RGB display signals corresponding to a pixel line of the display panel when the pixel line is selected, and a display controller for using a current value fed back by the common cathode and externally input RGB data to correct a white gray level of the RGB data and to generate RGB display data to the data driver.

15 Claims, 4 Drawing Sheets

U.S. PATENT DOCUMENTS

| | | | | |
|---|---|---|---|---|
| 2003/0063078 | A1* | 4/2003 | Hanari et al. | 345/204 |
| 2005/0057580 | A1* | 3/2005 | Yamano et al. | 345/690 |
| 2005/0068270 | A1* | 3/2005 | Awakura et al. | 345/76 |

FOREIGN PATENT DOCUMENTS

| | | |
|---|---|---|
| JP | 2002-311898 | 10/2002 |
| JP | 2003-195816 | 7/2003 |
| JP | 2004-138830 | 5/2004 |
| KR | 1020010014600 | 2/2001 |

* cited by examiner

IMAGE DISPLAY

CROSS REFERENCE TO RELATED APPLICATION

This application claims priority to and the benefit of Korean Patent Application No. 2003-8218 filed on Feb. 10, 2003 in the Korean Intellectual Property Office, the content of which is incorporated herein by reference in its entirety.

BACKGROUND OF THE INVENTION (a) Field of the Invention

The invention relates to an image display having pixels, the light emitting brightness of which is controlled by display signals. More specifically, the invention relates to an active matrix image display capable of controlling the current supplied to the light emitting element using active elements including an insulated gate FET (field-effect transistor) installed in each pixel.

(b) Description of the Related Art

Generally, a plurality of pixels are arranged in a matrix pattern and images are displayed by controlling the intensity of the light of each pixel based on given display signals in an active matrix image display.

Organic EL image displays are self-luminous displays which have light emitting elements, such as OLEDs (organic light emitting diodes), in each pixel. Organic EL image displays exhibit high visibility of images and a high response speed without requiring any backlight. The brightness of each light-emitting element is controlled by the amount of current supplied to the light emitting element. Namely, the organic EL image display is different from the LCD (liquid crystal displays) in that the light-emitting element is of a current-driven or current-controlled type.

The organic EL image display uses either a simple matrix type driving method or an active matrix type driving method. The simple matrix type driving method is simple in structure but is difficult for realizing a large-size display device and high resolution. Thus, there is increased demand for the earnest development of active matrix methods. In the active matrix type driving method, the current flowing to the light-emitting element in each pixel is controlled by an active element (usually a TFT (Thin Film Transistor) which is a type of an insulated gate FET) provided in the pixel.

In a conventional organic EL image display configured as above, a display operation is performed by a driving method where fixed gray levels (i.e., levels which do not depend on the brightness distribution by input RGB image data) are used for the display operation. That is, the display operation is performed with fixed gray levels, not gray levels which depend on whether the brightness of the display screen determined by brightness distribution of RGB (red, green, and blue) data is high or low. According to the above driving method, however, the brightness difference in a display screen becomes large when a difference between the number of ON-pixels and OFF-pixels is large. The brightness difference generates an uneven display in a screen.

To solve the above-noted problem, Korean publication application No. 2001-14600 (published on Feb. 26, 2001) discloses an active EL display. FIG. 1 shows a reference voltage generation circuit of the active EL display disclosed in Korean publication application No. 2001-14600.

The conventional image display detects the current fed back by a display panel, and generates the reference voltage to be applied to the display panel according to the detected current values. Referring to FIG. 1, the reference voltage generation circuit comprises a cathode end 1 of the display panel, a current detector 2 for converting the current flowing to the cathode end 1 into a voltage, an inverting amplifier 3 for inverting and amplifying an output voltage of the current detector 2, and a current amplifier 4 for amplifying the current of the output signal of the inverting amplifier 3 and generating a reference voltage Vdd to be supplied to EL elements installed in the respective pixels on the display panel.

The conventional image display receives the fed-back current from a common cathode of the EL elements provided to each pixel of the display panel, determines the reference voltage Vdd for supply to the respective EL elements according to the current values, and outputs the determined value. Therefore, the brightness of the EL elements can be controlled through control of the reference voltage Vdd. However, when the reference voltage Vdd is reduced, a number of the gray levels is reduced in the above image display, and when the reference voltage Vdd is supplied to the respective EL elements of the display to cause the current flowing to the EL elements to be varied, the reference voltage Vdd also instantly varies and flickers a display screen.

SUMMARY OF THE INVENTION

The invention provides an image display for detecting an amount of emitted light from the current flowing to the EL elements of each pixel, and varying a white gray level of a data voltage supplied to each EL element to control the amount of emitted light in the case of displaying an image through image data.

In one aspect of the invention, an image display comprises a display panel including a plurality of pixels arranged in a matrix pattern, a plurality of first electrodes individually formed corresponding to the pixels, a second electrode formed in common with the first electrodes, a plurality of light emitting elements provided between the first electrode and the second electrode and including a light emitting layer, and a plurality of TFTs. The plurality of TFTs are provided corresponding to the pixels and are connected between the first electrodes and a power supply voltage line for controlling the current supply to the EL elements. The display panel also includes a scan driver for sequentially selecting respective pixel lines on the display panel, a data driver for applying an RGB display signal corresponding to a pixel line of the display panel each time the pixel line is selected, and a display controller for using a current value fed back by the second electrode of the display panel and externally input RGB data to correct a white gray level of the RGB data and generate RGB display data, and providing the generated RGB display data to the data driver. The display controller determines an amount of emitted light on the corresponding screen according to the fed back current to generate a brightness control reference signal corresponding to the amount of emitted light, and controls the white gray level of the RGB data according to the brightness control reference signal to control the brightness.

The image display according to an exemplary embodiment of the invention receives the current flowing to the second electrode of the display panel to determine the amount of emitted light on the screen, and controls the voltage of the RGB data according to the amount of emitted light to solve the problem of uneven screen display caused by the difference is the amount of emitted light on the screen. Also, the image display does not sequentially control the reference voltage supplied to the display panel, but controls the voltage of the RGB data to reach a target voltage value to cancel the flickering of the screen.

In another aspect of the invention, an image display comprises a display panel including a plurality of pixels arranged in a matrix pattern, a plurality of first electrodes individually formed corresponding to the pixels, a plurality of second electrodes commonly formed for a plurality of groups defined by defining the first electrodes as the groups, a plurality of light emitting elements provided between the first electrode and the second electrode and including a light emitting layer, and a plurality of transistors provided corresponding to the pixels and connected between the first electrodes and a power supply voltage line for controlling the current supply to the EL elements. The display further includes a scan driver for sequentially selecting respective pixel lines, a data driver for applying an RGB display signal corresponding to a pixel line of the display panel each time the pixel line is selected, and a display controller for using a current value fed back by at least one second electrode of the display panel and externally input RGB data to correct a white gray level of the RGB data and generate RGB display data, and providing the generated RGB display data to the data driver. The display controller determines an amount of emitted light on the corresponding screen according to the fed back current to generate a brightness control reference signal corresponding to the amount of emitted light, and controls the white gray level of the RGB data according to the brightness control reference signal to control the brightness.

In another aspect of the invention, there is provided a method for driving an image display, comprising sequentially selecting respective pixel lines, applying an RGB display signal corresponding to a pixel line of the display panel each time the pixel line is selected, and using a current value fed back by the second electrode of the display panel and externally input RGB data to correct a white gray level of the RGB data and generate RGB display data, and to provide the generated RGB display data to a data driver.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE EXEMPLARY EMBODIMENTS

In the following detailed description, only the exemplary embodiment of the invention have been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
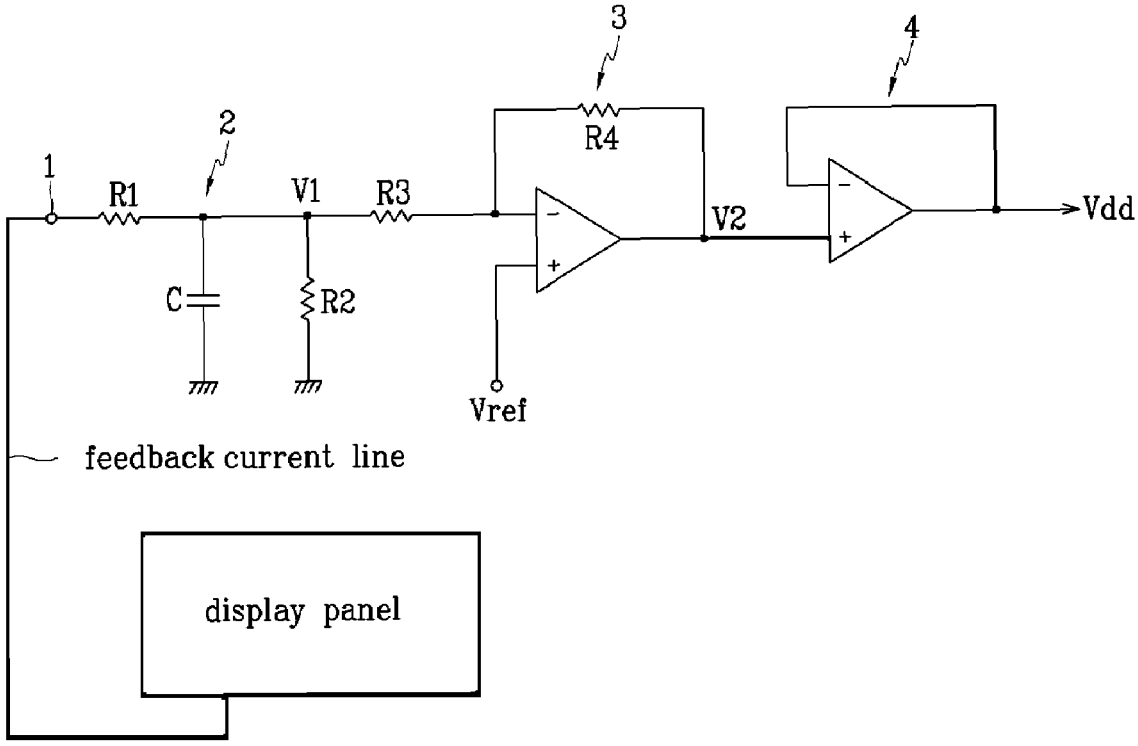
FIG. 1 (Prior Art)
FIG. 1 shows a reference voltage generation circuit of a conventional image display.
Figure 2:
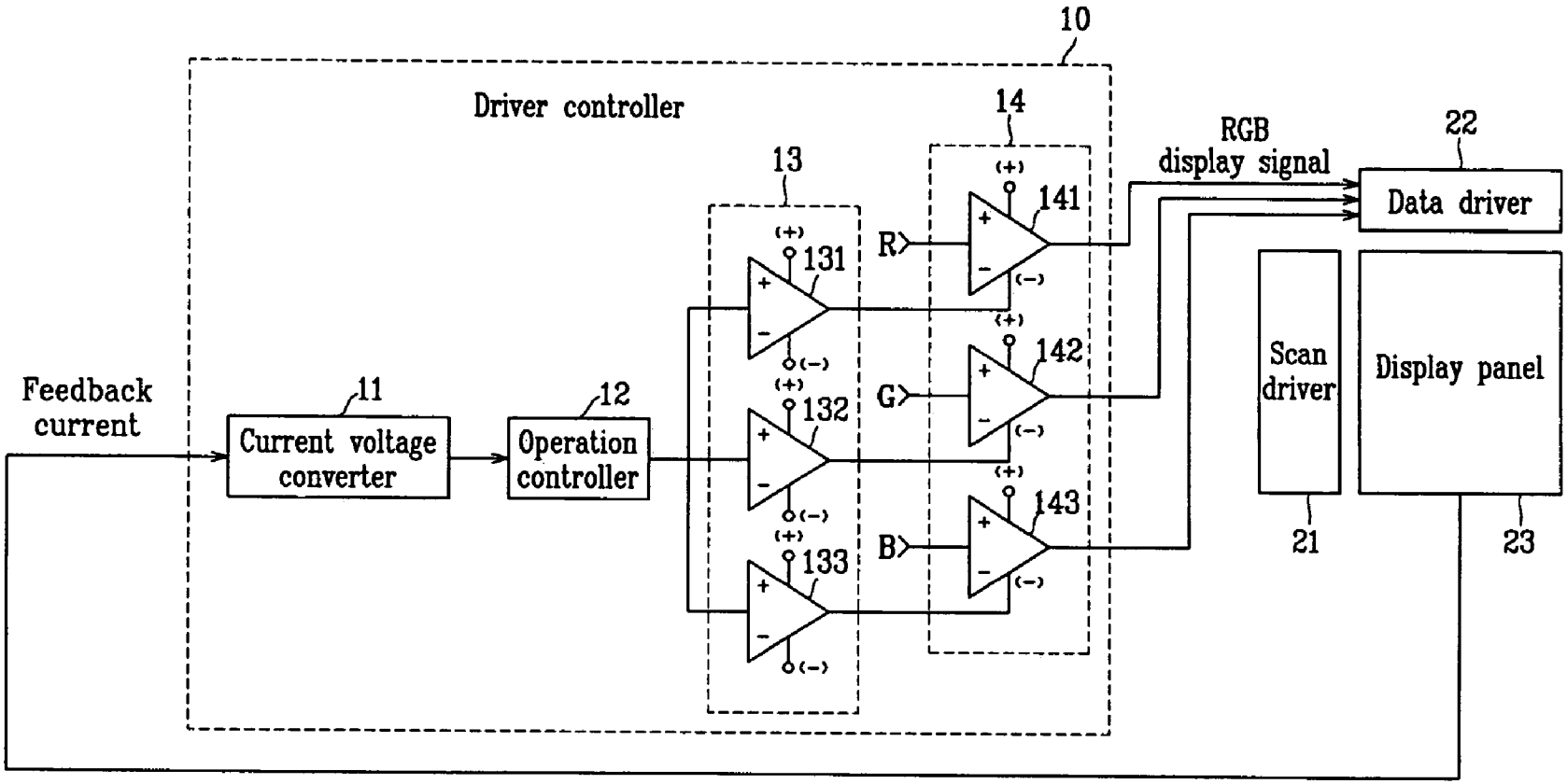
FIG. 2 shows a whole configuration of an image display according to an exemplary embodiment of the invention.
Figure 3:
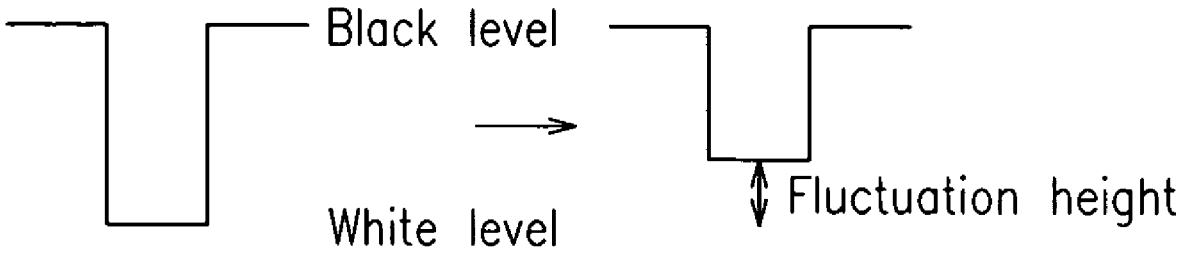
FIG. 3 shows a brightness control process of the white gray level of the R, G, and B data voltages in the image display shown in FIG. 2.

FIG. 2 shows a whole configuration of an image display according to an exemplary embodiment of the invention; and FIG. 3 shows a brightness control process of the white gray level of the R, G, and B data voltages in the image display shown in FIG. 2.

As shown in FIG. 2, the image display comprises a display controller 10, a current voltage converter 11 for receiving the feedback current, an operation controller 12, a data voltage ratio controller 13, a data voltage amplifier 14, a scan driver 21, a data driver 22, a display panel 23. In this instance, the display panel 23 has pixels arranged in a matrix pattern. That is, the display panel 23 comprises a plurality of anodes individually formed corresponding to respective pixels, cathodes commonly formed with respect to the anodes, a plurality of EL elements provided between the anodes and the cathodes and including a light emitting layer, and a plurality of TFT's (thin film transistors) provided corresponding to each pixel, and coupled between the anodes and a power supply voltage line, for controlling the current to the EL elements. The summation of the currents flowing to the pixels, that is, the currents flowing to the common cathode from the anodes of the pixels are provided as a feedback current to the current voltage converter 11.

The current voltage converter 11, the operation controller 12, the data voltage ratio controller 13, and the data voltage amplifier 14 use the current fed back by the display panel 23 and externally input RGB data to correct the white gray level of the RGB data and generate RGB display signals, and provide the generated RGB display signals to the data driver 22, thereby operating as a display controller 10.

The current voltage converter 11 generates a voltage having a level corresponding to the input current. The operation controller 12 detects the total amount of the emitted light according to the intensity of the voltage input by the current voltage converter 11, generates a brightness control reference signal corresponding to the amount of the emitted light, and outputs the brightness control reference signal. For example, the operation controller 12 generates a brightness control reference signal for controlling the brightness to reduce the voltage when the amount of the emitted light on the screen is greater than a predetermined reference value, and generates a brightness control reference signal for controlling the brightness to increase the voltage when the amount of the emitted light on the screen is less than a predetermined reference value.

The brightness control reference signal output by the operation controller 12 is input to the data voltage ratio controller 13. The data voltage ratio controller 13 may comprise three operational amplifiers 131, 132, and 133 respectively processing the brightness control reference signals of the three RGB colors. In detail, the operational amplifiers 131, 132, and 133 amplify the brightness control reference signal to generate white gray level control signals of the RGB data to the data voltage amplifier 14. The data voltage amplifier 14 may comprise operational amplifiers 141, 142, and 143 corresponding to the respective colors R, G, and B. The operational amplifiers 141, 142, and 143 receive white gray level control signals from the operational amplifiers 131, 132, and 133 corresponding to the data voltage ratio controller 13, together with the RGB data of the corresponding colors.

As shown in FIG. 3, driving voltages of the operational amplifiers 141, 142, and 143 are controlled by the white gray level control signal according to an amplification operation of the operational amplifiers 141, 142, and 143 to thereby control the white gray level fluctuation height of the corresponding RGB data. Output signals of the respective operational amplifiers 141, 142, and 143 of the data voltage amplifier 14 are provided as RGB display data to the data driver 22. The scan driver 21 sequentially selects pixel lines of the display panel 23, and the data driver 22 supplies the RGB display signals provided by the data voltage amplifier 14 to the selected pixel line. Accordingly, the current corresponding to the RGB display signal flows to the EL element in each pixel of the display panel 23, thereby performing a light emitting operation, and an image by the RGB display signals can be displayed on the whole screen. As shown in FIG. 3, the black level of the RGB display signal output by the data voltage amplifier 14 is fixed, and the white gray level is controlled. Therefore, when the screen's amount of emitted light is large from the current fed back by the display panel 23, the voltage of the RGB data is controlled to reduce the voltage, and when the amount of emitted light is small, the voltage of the RGB data is controlled to increase the voltage, thereby realizing an appropriate and easy-to-view screen display according to the screen's amount of emitted light.

Figure 4:
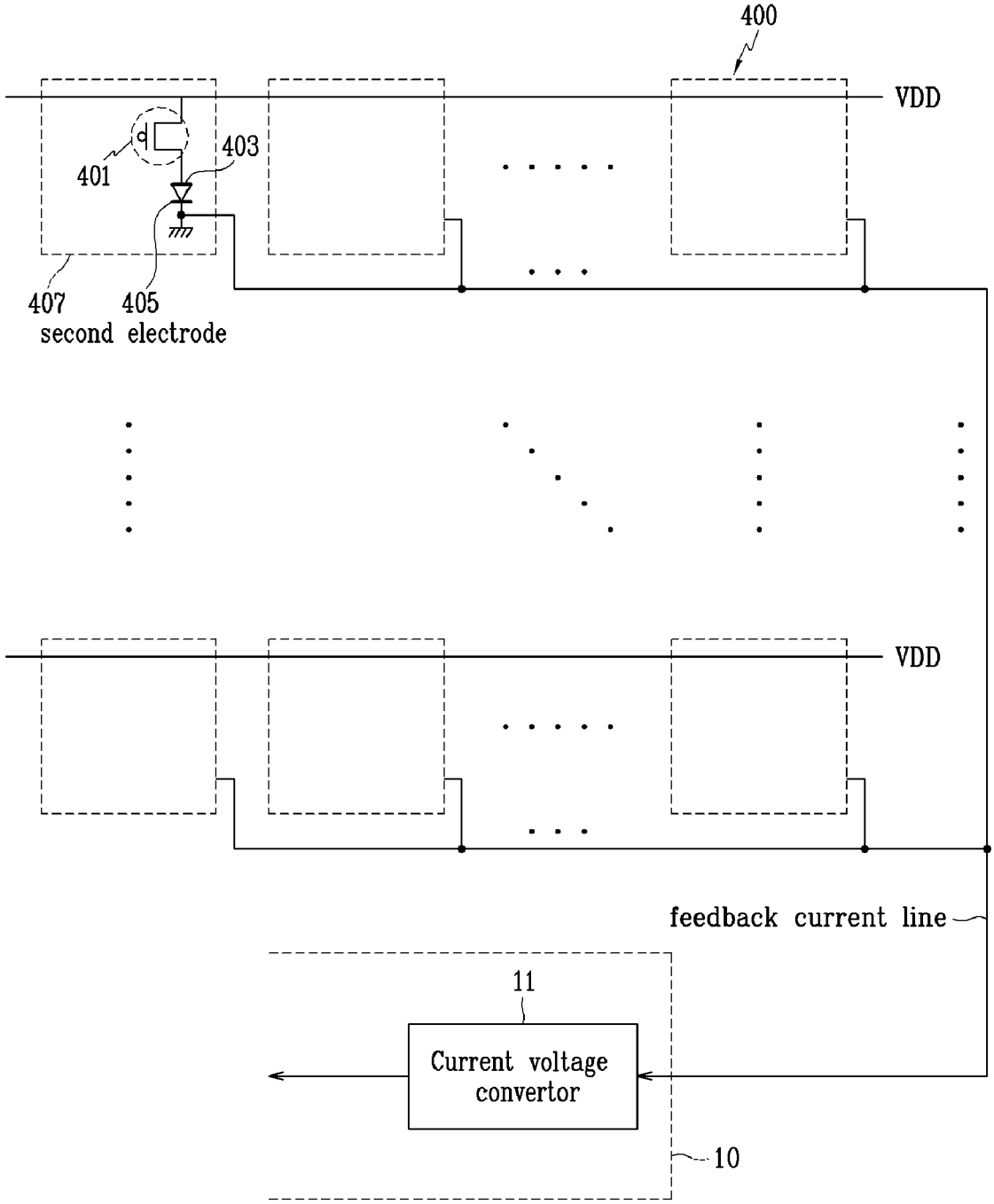
FIG. 4 is a diagram illustrating the details of a display panel constructed according to the principles of the invention.

As shown in FIG. 4, an embodiment of the invention may include a display panel including pixels 407 arranged in a matrix. Each pixel 407 includes a transistor 401 and a light emitting element arranged between a first electrode 403 and a second electrode 405. The light emitting element includes a light emitting layer. One of the first electrode 403 or the second electrode 405 of each pixel 407 may be a common electrode of the display panel. A first terminal of the transistor 401 may be coupled with a power supply voltage line VDD, and a second terminal of the transistor 401 may be coupled with the first electrode 403. A control terminal of the transistor 401 may be coupled with a gate line (not shown).

As described above, the image display receives the current flowing to the common cathode of the display panel to determine the screen's amount of emitted light, and sequentially controls the voltage of the RGB data to be converged to a target voltage value according to the amount of the emitted light, thereby solving the problem of uneven screen display. Also, the flickering of the screen is overcome by controlling not the reference voltage supplied to the display panel, but the voltage of the RGB data.

A single common cathode may be formed in an embodiment of the invention, and a plurality of common cathodes can further be formed. In this instance, a plurality of anodes is defined as a single group, and a common cathode is formed for each group.

While this invention has been described in connection with what is presently considered to be the most practical embodiment, it is to be understood that the invention is not limited to the disclosed embodiments, but, on the contrary, is intended to cover various modifications and equivalent arrangements included within the spirit and scope of the appended claims.

What is claimed is:

1. An image display, comprising:

a display panel including a plurality of pixels arranged in a matrix pattern, a plurality of first electrodes individually formed corresponding to the pixels, a second electrode formed in common with the first electrodes, a plurality of light emitting elements provided between the first electrode and the second electrode and including a light emitting layer, and a plurality of transistors provided corresponding to the pixels and connected between the first electrodes and a power supply voltage line for controlling the current supply to the EL elements;

a scan driver for sequentially selecting respective pixel lines;

a data driver for applying an RGB display signal corresponding to a pixel line of the display panel each time the pixel line is selected; and a display controller for using a current value fed back from the second electrode of the display panel and externally input RGB data to correct a white gray level of the RGB data and generate RGB display data, and for providing the generated RGB display data to the data driver, wherein the display controller determines an amount of emitted light on the corresponding screen according to the fed back current to generate a brightness control reference signal corresponding to the amount of emitted light, and controls the white gray level of the RGB data according to the brightness control reference signal to control the brightness of the display panel.

2. The image display of claim 1, wherein the display controller comprises:

a current voltage converter for outputting a voltage having a level corresponding to the current fed back from the second electrode of the display panel;

an operation controller for detecting the total amount of the emitted light according to the intensity of the voltage input by the current voltage converter, generating a brightness control reference signal corresponding to the amount of the emitted light, and outputting the brightness control reference signal;

a data voltage ratio controller for amplifying the brightness control reference signal input by the operation controller to generate a white gray level control signal for each color of RGB, and output the signal; and a voltage amplifier for amplifying the RGB data, receiving the white gray level control signal, controlling a driving voltage of an amplifier, and controlling a fluctuation height of the white gray level of the RGB data to generate and output RGB display data.

3. The image display of claim 2, wherein the operation controller generates a brightness control reference signal for controlling the brightness to reduce the fluctuation height of the white gray level of the RGB data when the amount of the emitted light on the screen is greater than a predetermined reference value, and generates a brightness control reference signal for controlling the brightness to increase the fluctuation height of the white gray level of the RGB data when the amount of the emitted light on the screen is less than the predetermined reference value.

4. The image display of claim 2, wherein the data voltage ratio controller includes three operational amplifiers for respectively processing the brightness control reference signal of the RGB data.

5. The image display of claim 2, wherein the data voltage amplifier includes three operational amplifiers for processing the RGB data by respectively receiving RGB data and a corresponding brightness control reference signal to control the fluctuation height of the white gray level of the RGB data and generating RGB display signals.

6. The image display of claim 1, wherein the current fed back from the display panel is a summation of currents flowing to the second electrode from the first electrodes of the respective pixels.

7. An image display, comprising:

a display panel including a plurality of pixels arranged in a matrix pattern, a plurality of first electrodes individually formed corresponding to the pixels, a plurality of second electrodes commonly formed for a plurality of groups defined by defining the first electrodes as the groups, a plurality of light emitting elements provided between the first electrode and the second electrode and including a light emitting layer, and a plurality of transistors provided corresponding to the pixels and connected between the first electrodes and a power supply voltage line for controlling the current supply to the EL elements;

a scan driver for sequentially selecting respective pixel lines;

a data driver for applying an RGB display signal corresponding to a pixel line of the display panel each time the pixel line is selected; and a display controller for using a current value fed back from at least one second electrode of the display panel and externally input RGB data to correct a white gray level of the RGB data and to generate RGB display data, and for providing the generated RGB display data to the data driver, wherein the display controller determines an amount of emitted light on the corresponding screen according to the fed back current to generate a brightness control reference signal corresponding to the amount of emitted light, and controls the white gray level of the RGB data according to the brightness control reference signal to control the brightness of the display panel.

8. A method for driving an image display, comprising:

sequentially selecting respective pixel lines;

applying an RGB display signal corresponding to a pixel line of the display panel each time the pixel line is selected; and using a current value fed back from a second electrode of the display panel and externally input RGB data to correct a white gray level of the RGB data and generate RGB display data, and to provide the generated RGB display data to a data driver.

9. An image display, comprising:

a display panel including a plurality of pixels arranged in a matrix pattern;

a scan driver for sequentially selecting respective pixel lines;

a data driver for applying an RGB display signal corresponding to a pixel line of the display panel each time the pixel line is selected; and a display controller for using a current value fed back from an electrode of the display panel and externally input RGB data to correct a white gray level of the RGB data and generate RGB display data, and for providing the generated RGB display data to the data driver, wherein the display controller determines an amount of emitted light on the corresponding screen according to the fed back current to generate a brightness control reference signal corresponding to the amount of emitted light, and controls the white gray level of the RGB data according to the brightness control reference signal to control the brightness of the display panel.

10. The image display of claim 9, wherein the display controller comprises:

a current voltage converter for outputting a voltage having a level corresponding to the current fed back from the display panel;

an operation controller for detecting the total amount of the emitted light according to the intensity of the voltage input by the current voltage converter, generating a brightness control reference signal corresponding to the amount of the emitted light, and outputting the brightness control reference signal;

a data voltage ratio controller for amplifying the brightness control reference signal input by the operation controller to generate a white gray level control signal for each color of RGB, and output the signal; and a voltage amplifier for amplifying the RGB data, receiving the white gray level control signal, controlling a driving voltage of an amplifier, and controlling a fluctuation height of the white gray level of the RGB data to generate and output RGB display data.

11. The image display of claim 10, wherein the operation controller generates a brightness control reference signal for controlling the brightness to reduce the fluctuation height of the white gray level of the RGB data when the amount of the emitted light on the screen is greater than a predetermined reference value, and generates a brightness control reference signal for controlling the brightness to increase the fluctuation height of the white gray level of the RGB data when the amount of the emitted light on the screen is less than the predetermined reference value.

12. The image display of claim 10, wherein the data voltage ratio controller includes three operational amplifiers for respectively processing the brightness control reference signal of the RGB data.

13. The image display of claim 10, wherein the data voltage amplifier includes three operational amplifiers for processing the RGB data by respectively receiving RGB data and a corresponding brightness control reference signal to control the fluctuation height of the white gray level of the RGB data and generating RGB display signals.

14. The image display of claim 9, wherein the current fed back from the electrode of the display panel is a summation of currents flowing to a second electrode from one or more first electrodes that each correspond to a respective pixel.

15. A method for driving an image display, comprising:

sequentially selecting respective pixel lines;

applying an RGB display signal corresponding to a pixel line of the display panel each time the pixel line is selected; and using a current value fed back from an electrode of a display panel and externally input RGB data to correct a white gray level of the RGB data and generate RGB display data, and to provide the generated RGB display data to a data driver.

* * * * *